United States Patent [19]

Yamamoto et al.

[11] Patent Number: 4,926,168

[45] Date of Patent: May 15, 1990

[54] LIQUID CRYSTAL DISPLAY DEVICE HAVING A RANDOMLY DETERMINED POLARITY REVERSAL FREQUENCY

[75] Inventors: Kunihiko Yamamoto; Yutaka Ishii, both of Nara, Japan

[73] Assignee: Sharp Kabushiki Kaisha, Osaka, Japan

[21] Appl. No.: 198,870

[22] Filed: May 27, 1988

[30] Foreign Application Priority Data

May 29, 1987 [JP] Japan ..... 62-133817

[51] Int. Cl.[5] ..... G09G 3/36

[52] U.S. Cl. ..... 340/784; 340/805

[58] Field of Search ..... 340/784, 805, 765; 350/332, 333; 358/230, 236

[56] References Cited

U.S. PATENT DOCUMENTS 4,702,560 10/1987 Endo et al. ..... 340/784

FOREIGN PATENT DOCUMENTS 0020027 4/1980 European Pat. Off. .
0216168 8/1986 European Pat. Off. .
645473 12/1978 Switzerland .

OTHER PUBLICATIONS

Patent Abstracts of Japan, vol. 9, No. 181 (E331) Jul. 26, 1985.

*Primary Examiner*—Jeffery A. Brier

[57] ABSTRACT

A liquid crystal display device containing an X-Y matrix type liquid crystal display panel in which these are M (M>1) signal electrodes and N (N>1) scanning electrodes are arranged in a matrix. The liquid crystal display device utilizes a device which reverses the polarity of the voltage waveform applied to the liquid crystal display panel at intervals of n (1<n<N) horizontal scanning periods. The polarity reversing timing of this waveform is set randomly for a certain predetermined number of frames, for example, every two frames. The random setting of the polarity reversing timing substantially eliminates crosstalk and linear display irregularity. The polarity reversing timing is realized by a random number generator in a reversing circuit which can be attached to a conventional liquid crystal display device such that this reversing circuit can randomly reverse the conventional polarity reversal signal.

11 Claims, 6 Drawing Sheets

LIQUID CRYSTAL DISPLAY DEVICE HAVING A RANDOMLY DETERMINED POLARITY REVERSAL FREQUENCY

BACKGROUND OF THE INVENTION

The present invention relates to a liquid crystal display device containing an X-Y matrix type liquid crystal display panel.

Conventionally, an X-Y matrix type liquid crystal display panel is driven in either of the following two well-known methods: Method A in which the polarity of applied voltage is reversed in one horizontal scanning period as shown in FIG. 6, and Method B in which the polarity of applied voltage is reversed for each frame as shown in FIG. 7. The waveforms shown in FIGS. 6 and 7 include waveform distortion caused by the electrostatic capacity of the liquid crystal panel and by the resistance of the transparent electrodes. Method A provides a smaller ratio of waveform frequency variation in the display pattern than method B does (the frequency change ratio is 2 in method A whereas it is N in the method B when the duty ratio is N), but provides a higher frequency in general, resulting in larger power consumption. When using a larger liquid crystal display panel in which the liquid crystal capacity and the electrode resistance increase, method A is influenced significantly by waveform distortion so that the effective applied voltage drops. Because of this reason, method A is hardly used for large liquid crystal display panels.

Presently, therefore, an X-Y matrix type liquid crystal display panel is driven by method B. For a large high density liquid crystal panel in which the number of time divisions exceeds 100, however, method B tends to cause irregular picture and crosstalk which deteriorates the picture quality seriously.

FIG. 8 shows the typical crosstalk phenomenon. A pattern is shown where black portions 2 should be normally displayed against a white background 1 suffers crosstalk so that portion 3 which should be white become gray. The driving waveforms for the portions 1 and 3 are shown in FIG. 9; waveforms (1) and (2), respectively. In the waveform (1) of FIG. 9 that is, of the portion 1 in FIG. 8, the driving frequency component of the display pattern is mainly a low frequency, whereas in the waveform (2) of FIG. 9, that is, in the portions 3 of FIG. 8, the driving frequency component of the display pattern is mainly a high frequency. The difference in the frequency component of the driving waveforms results in a conspicuous crosstalk phenomenon. In other words, crosstalk can be caused by the diversified frequency characteristic of the threshold voltage of the liquid crystal display panel or by the variation of effective voltage caused by distorted driving waveform.

The former cause occurs when the threshold voltage of the liquid crystal display panel changes in a driving frequency band although the effective voltage is constant. The driving frequency band varies depending upon the driving method. As mentioned above, the frequency variation ratios of the conventional methods A and B are 2 and N (N is a duty ratio), respectively. When the threshold voltage of the liquid crystal display panel changes with frequency, method A is advantageous over method B in terms of the crosstalk phenomenon because the driving frequency variation ratio is smaller in method A. On the other hand, method A has a disadvantage of larger power consumption.

A driving method from which the above problems are eliminated has been proposed. This method is to reverse the polarity of driving voltage applied to the liquid crystal display panel at intervals corresponding to specified horizontal scanning periods. According to this method, the advantage of method B can be made use of, while power consumption is minimized. To explain this method, the driving waveforms in which the polarity of the waveforms (1) and (2) of FIG. 9 is reversed every four horizontal scanning periods (4H) are shown in waveforms (1) and (2) of FIG. 10, respectively. In these waveforms, the frequency of polarity reversing signal is the major component of the driving frequency, so that the influence by the frequency of the display pattern is reduced. Namely, in this method, the driving frequency having a low frequency component near the frame frequency is shifted to the higher frequency side so as to equalize the driving frequency component for each picture element. Moreover, the waveform distortion is also equalized as shown in FIG. 10, and the effective voltage value is held constant to some extent in this method.

The above method has an effect of reducing crosstalk phenomenon. But it has another problem in that linear display irregularity is generated along the scanning lines when polarity is reversed. This display irregularity is caused by the following reason.

In waveforms (1)–(5) of FIG. 11 show examples of driving waveforms in the liquid crystal display device. In these figures, waveform distortion caused by the electrostatic capacity of the liquid crystal panel and by the resistance of the transparent electrodes is also taken into account.

Waveforms (1) and (2) of FIG. 11 show the waveform of the driving voltage applied to the scanning electrodes. The waveform (1) of FIG. 11 is for the case where a selection pulse is generated immediately after the reversal of polarity, and the waveform (2) of FIG. 11 is for another case. Waveform (3) of FIG. 11 shows the waveform of driving voltage applied to the signal electrodes. This waveform is for the case where all picture elements are turned off. Waveform (4) of FIG. 11 shows the potential difference between the waveform (1) of FIG. 11 and that of waveform (3), and waveform (5) of FIG. 11 shows the potential difference between the waveforms of (2) and (3) of FIG. 11. Both are the waveforms of the voltage applied to the picture elements. As shown, waveform distortion is different between waveforms (4) and (5) of FIG. 11. This difference in the waveform distortion causes a uniform effective voltage to be applied to picture elements, resulting in the linear display irregularity. This problem can be solved by shifting the polarity reversing point by 1H (one horizontal scanning period) in each frame to equalize the waveform distortion in each scanning line, thereby making the effective voltage uniform. In this case, however, a driving frequency component smaller than the frame frequency is produced. This results in meandering display irregularity which occurs in the downward direction on the screen during the sequential scanning.

As mentioned above, crosstalk occurs in the conventional liquid crystal display device, and if action is taken to eliminate the crosstalk, linear display irregularity or meandering phenomenon is observed on the screen.

SUMMARY OF THE INVENTION

Accordingly, an object of the present invention is to provide a liquid crystal display device capable of producing a uniform and high quality display.

Another object of the present invention is to provide a liquid crystal display device driving method which realizes a uniform and high quality display free from crosstalk, display irregularity and meandering phenomenon.

Other objects and further scope of applicability of the present invention will become apparent from the detailed description given below. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, according to an embodiment of the present invention, a liquid crystal display device comprises an X-Y matrix type liquid crystal display panel in which M pcs. of signal electrodes ($M>1$) and N pcs. of scanning electrodes ($N>1$) are arranged in a matrix, and means for reversing or inverting the polarity of the voltage applied to the liquid crystal display panel at an interval of n horizontal scanning period ($1<n<N$) as well as for randomly setting the reversing timing at an interval of the predetermined number of frames.

In the liquid crystal display device of the above construction, the driving frequency is independent of the display pattern and governed by the frequency of a polarity-reversing signal. In addition, the polarity reversing timing changes randomly every predetermined number of frames, say, every two frames, so that the effective voltage values on the scanning lines are maintained constant.

BRIEF DESCRIPTION OF THE DRAWINGS

The present invention will become more fully understood from the detailed description given below and the accompanying drawings which are given by way of illustration only, and thus are not limitative of the present invention and wherein.

DETAILED DESCRIPTION OF THE EMBODIMENTS

According to an embodiment of the present invention, a liquid crystal display device contains an X-Y matrix type liquid crystal display panel comprising a pair of insulating substrates with a liquid crystal layer sandwiched therebetween, N pcs. of scanning electrodes provided on the inner side of one of the insulating substrates, and M pcs. of signal electrodes provided on the inner side of the other substrate, the scanning electrodes and the signal electrodes crossing each other at a right angle. In the following description, it is assumed that N is 200 and M is 640, although the numbers for M and N are not limited to these.

Figure 1:
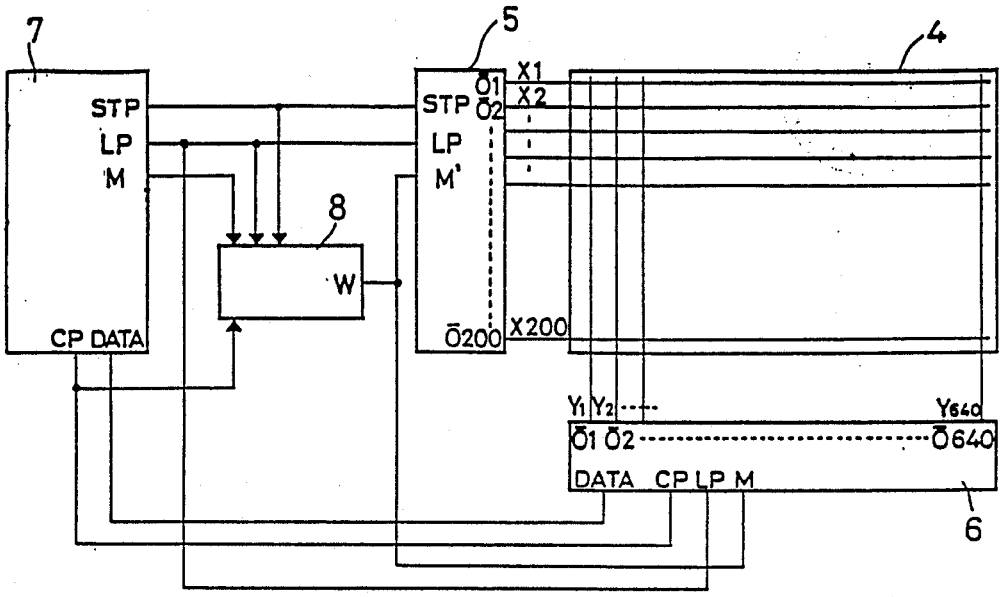
FIG. 1 is a block circuit diagram of the liquid crystal display device of an embodiment of the present invention.
Figure 2:
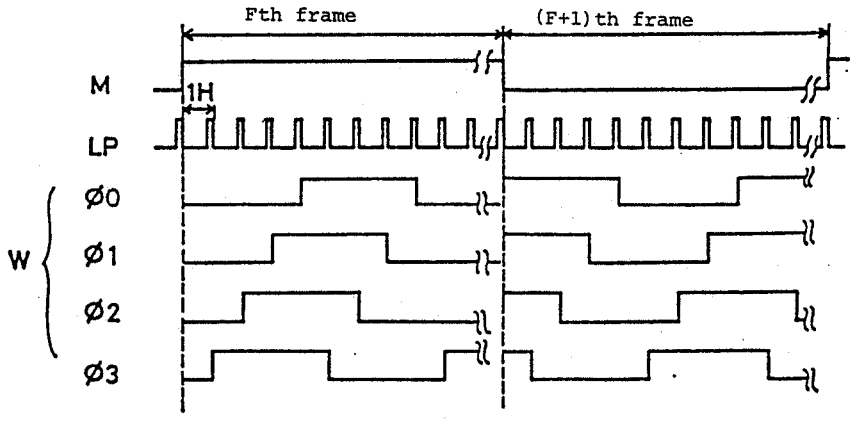
FIG. 2 is a chart of signal waveforms in the essential parts thereof.

Referring to FIG. 1 which shows the embodiment of the invention, an X-Y matrix type liquid crystal display panel 4 (hereinafter referred to simply as a liquid crystal panel) comprises a liquid crystal layer placed between a pair of insulating substrates, scanning electrodes $X_1$, $X_2$, . . . $X_{200}$ formed on the inner side of one of the pair of insulating substrates, and signal electrodes $Y_1$, $Y_2$, . . . $Y_{640}$ formed on the inner side of the other insulating substrate, the scanning electrodes crossing the signal electrodes. Here, the insulating substrate may be made of a conducting member with insulating film applied thereon, or made of a conducting member alone. Insulating films are provided on the signal electrodes and scanning electrodes. Reference item 5 is a scanning electrodes driver, and reference item 6 is a signal electrode driver. A controller 7 supplies the drivers 5 and 6 with specified signals. Specifically, the controller 7 outputs display data DATA, dot clock pulse CP to control the receiving of the display data and latch pulse LP to the signal electrode driver 6. When 640 dot clock pulses CP have been outputted to receive the data for one line in the signal electrode driver 6, the latch pulse LP is outputted, making the signal electrode driver 6 latch the data for one line. The signal electrode driver 6 outputs 640 liquid crystal-driving signals on the basis of the latched data. In the present embodiment of the present invention, it is assumed the latch pulse is outputted every individual horizontal scanning period (1H) as shown in FIG. 2.

The controller 7 outputs start pulse STP and latch pulse LP to the scanning electrode driver 5. Using the latch pulse LP as a clock pulse, the scanning electrode driver 5 shifts the selection waveform sequentially. The period required for outputting 200 latch pulses LP to complete selection of all the scanning electrodes is one frame. One frame is normally set at 50 to 60 Hz.

A polarity reversal control circuit 8 generates a reversal control signal W which reverses the polarity of the voltage waveform applied to the liquid crystal panel 4 at an interval of n ($1<n<200$) horizontal scanning lines and changes the reversing timing randomly every predetermined number of frames, say, every two frames. Start pulse STP, latch pulse LP, dot clock pulse CP and alternating signal M are supplied from the controller 7 to the polarity reversal control circuit 8. The alternating signal M is a binary signal which reverses for each frame, as shown in FIG. 2.

The driving method B uses an alternating signal M whose polarity reverses for each frame. Method A uses an alternating signal M whose polarity changes for each ½ horizontal scanning period. Conventionally, the alternating signal M is supplied as it is the scanning and signal electrode drivers 5 and 6. In the liquid crystal display device of the present invention, the alternating signal M is changed into a reversal control signal W by the polarity reversal control circuit 8 before being supplied to the drivers 5 and 6. The reversal control signal W outputted from the polarity reversal control signal 8 reverses its polarity at $n=4H$ (4 horizontal scanning periods) interval in each frame, and the polarity of the signal W at the beginning of each frame is opposite to that at the beginning of the preceding frame. The reversal control signal W provides four different phases $\phi_0$, $\phi_1$, $\phi_2$, $\phi_3$. One of the four phases of the reversal control signal W is selected randomly at an interval of predetermined number of frames, say, of two frames. This irregularity or randomness of the phase contributes to the uniform display being free from crosstalk. The reversing period need not be limited to 4H.

Figure 3:
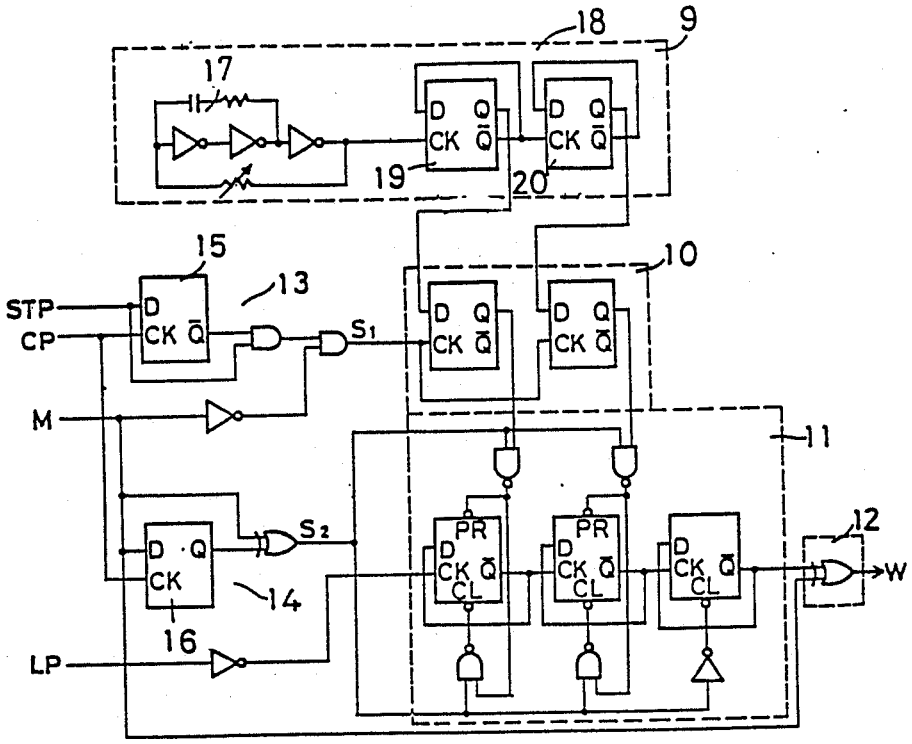
FIG. 3 is a detailed circuit diagram showing the polarity-reversal control circuit shown in FIG. 1.

FIG. 3 shows a specific example of the polarity reversal control circuit 8. Referring to FIG. 3, the polarity reversal control circuit 8 comprises a random number generating circuit 9, a latch circuit 10 for storing the output from the random number generating circuit 9 for predetermined number of frames, say, for two frames, a frequency dividing counter 11 which starts counting by reading the initial value at an interval of the predetermined number of frames, say, two frames, an exclusive OR circuit 12 which generates a reversal control signal W by determining the exclusive OR between the output from the frequency dividing counter 11 and an alternating signal M, a first circuit 13 for supplying clock signals $S_1$ to the latch circuit 10, and a second circuit 14 for supplying operation signals $S_2$ to the frequency dividing counter 11. The first and second circuits 13 and 14 contain first and second D flip flops 15 and 16, respectively.

The random number generating circuit 9 comprises an oscillator 17 which self-oscillates at nearly the same frequency as the horizontal scanning frequency and a quaternary counter 18 which divides the output from the oscillator 17 into four. The quaternary counter 18 comprises third and fourth D flip flops 19 and 20. The quaternary counter 18 sets the polarity reversing period "n" at 4H. When a decimal counter is used instead of the quaternary counter 18, n is set at 10H. However, since the polarity reversing period set by the quaternary or decimal counter is determined by the frequency of the self oscillator 17, the value for "n" can be changed as desired.

In addition to the function of determining the value for "n", the random number generating circuit 9 has a function of generating "n" kinds of phase (four kinds when n=4H, and 10 kinds when n=10H). This second function is based on the self oscillator 17 which self-oscillates at a certain appropriate frequency, independent of the signal systems of the controller 7. The output from the quaternary counter 18 of the random number generating circuit 9 is retained by a signal $S_1$ in the latch circuit 10 at an interval of predetermined number of frames, say, two frames. The output thus retained is further latched by a signal $S_2$ in the frequency dividing counter 11. The frequency dividing counter 11 generates a signal for reversing polarity at 4H intervals. The exclusive OR circuit 12 generates a polarity reversal control signal W by determining the exclusive OR between the output from the frequency dividing counter 11 and an alternating signal M from the controller 7. The signal W is supplied to the input terminals M and M' of the drivers 5 and 6 to change the driving voltage randomly.

Figure 4:
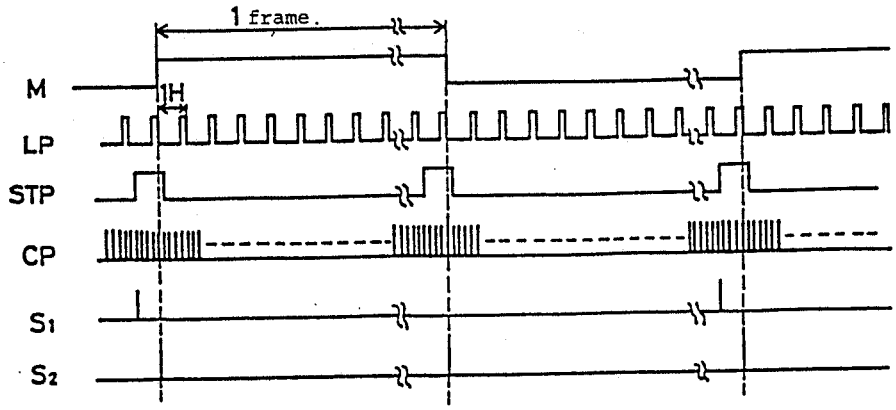
FIG. 4 is a waveform chart of signals supplied to various parts of the circuit shown in FIG. 3.
Figure 5:
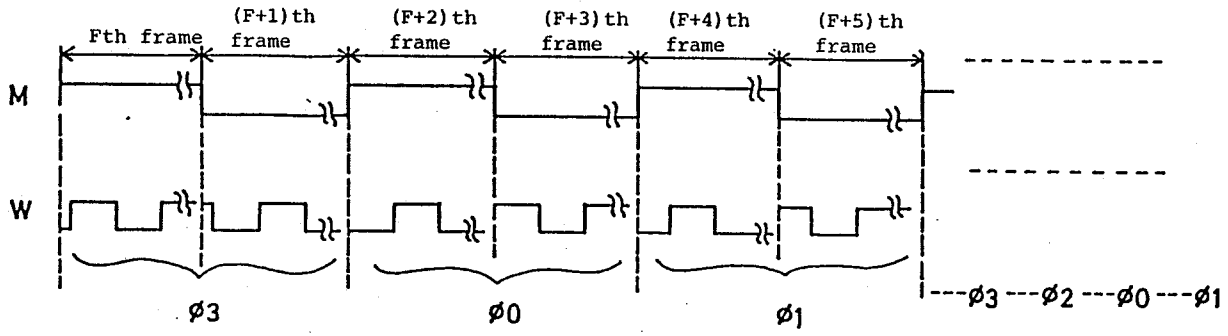
FIG. 5 is a chart for explaining one of the signals shown in FIG. 4.
Figure 6:
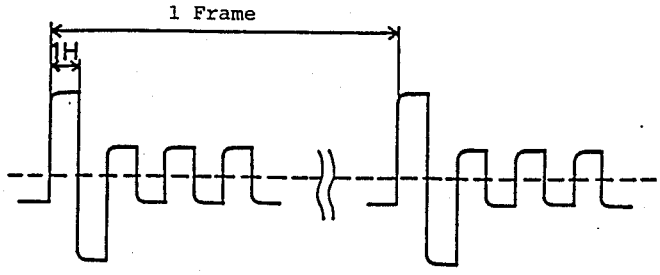
Fig. 6 (PRIOR ART)
FIGS. 6, 7, 8, 9, 10 and 11 are the drawings explaining the conventional liquid crystal display device.
Figure 7:
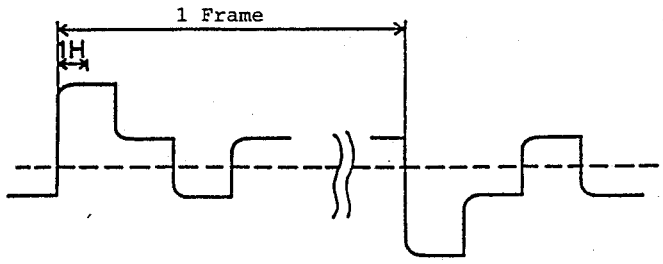
Fig. 7 (PRIOR ART)
Figure 8:
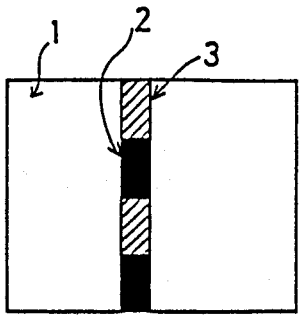
Fig. 8 (PRIOR ART)
Figure 9:
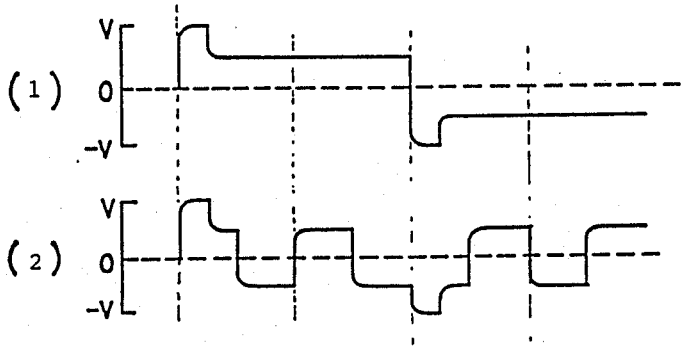
Fig. 9 (PRIOR ART)
Figure 10:
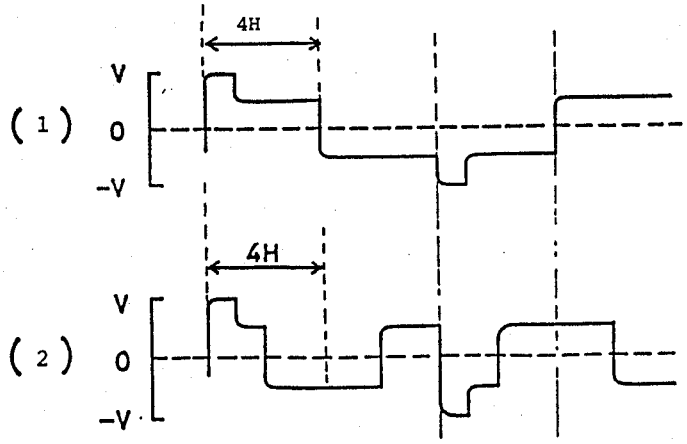
Fig. 10 (PRIOR ART)
Figure 11:
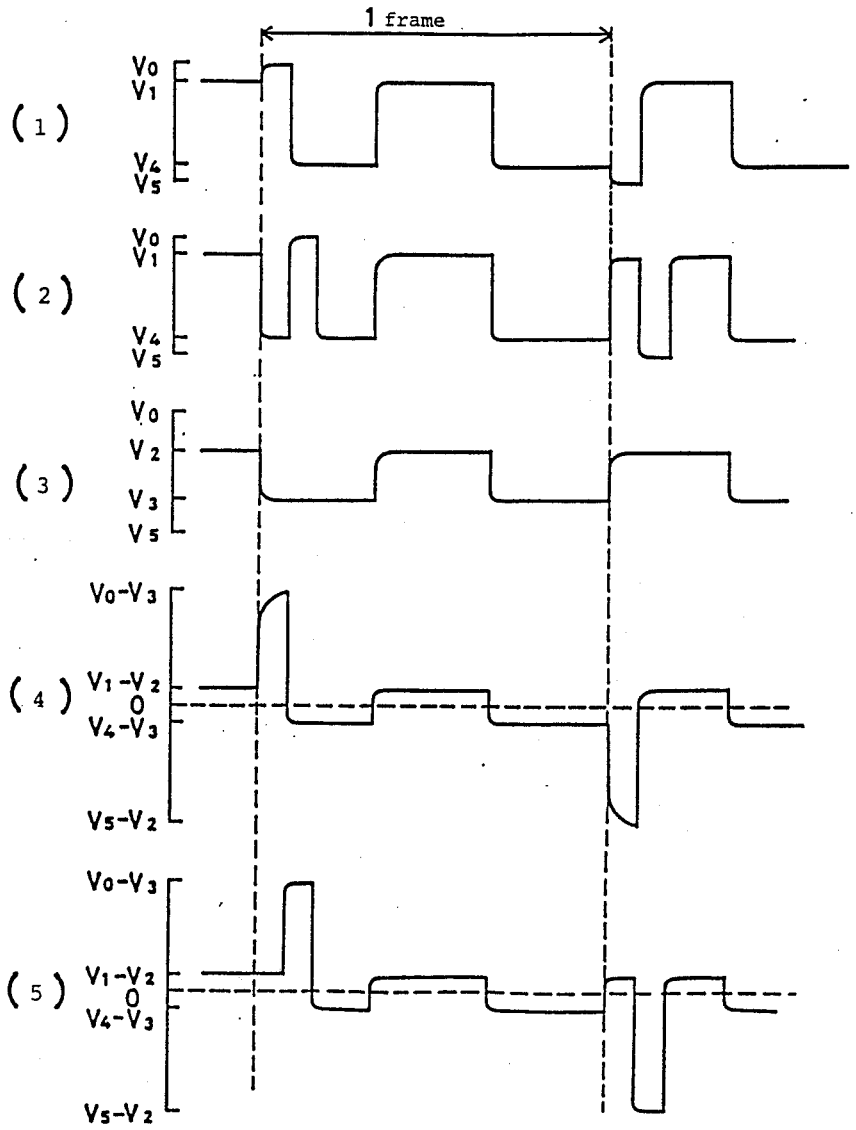
Fig. 11 (PRIOR ART)

The signal waveform at each part of FIG. 3 is shown in FIG. 4. The waveform of a polarity reversal control signal W is shown in comparison with that of an alternating signal M in FIG. 5. FIG. 5 indicates that a polarity reversal control signal W of the phase $\phi_3$ is generated for the Fth and (F+1)th frames, a polarity reversal control signal W of the phase $\phi_0$ for the (F+2)th and (F+3)th frames, and a polarity reversal control signal W of the phase $\phi_1$ for the (F+4)th and (F+5)th frames randomly. The polarity reversal control signal W of each phase is reversed in its polarity for each frame so as to enable an alternating drive which helps lengthen the life of the liquid crystal. This reversal of the polarity is realized by the function of the exclusive OR circuit 12.

As a result, the driving voltage, whose polarity is reversed regularly at intervals of n horizontal periods in each frame at a timing which changes randomly every predetermined number of frames, say, every two frames, is applied to the liquid crystal cells constituting the liquid crystal panel.

An embodiment of the present invention has been described above. All the components other than the polarity reversal control circuit 8 shown in FIG. 1 are conventional ones. Therefore, the liquid crystal display device of the present invention is realized easily by connecting the polarity reversal control circuit 8 to an existing system.

According to the present invention, as described above, since the waveform of the voltage applied to the liquid crystal panel (namely the liquid crystal-driving voltage) is reversed in its polarity at intervals of a plurality of scanning lines in each frame, the driving frequency change ratio is small, and the driving frequency component is independent of the display pattern and dominated by the frequency of a polarity-reversing signal. Consequently, crosstalk is hardly generated. Moreover, since the polarity reversing timing is set randomly for every predetermined number of frames, say, every two frames, the effective voltage values on the scanning lines are equalized. Therefore, the present invention is extremely effective in producing a picture free from linear display irregularity attributed to the polarity reversal and therefore free from the meandering irregularity.

In the above embodiment, the interval of changing the polarity-reversing timing is two frames, although it need not be limited to two frames. The polarity-reversing timing may be changed at any intervals of a plurality of frames.

The above description is based on the assumption that the number of scanning electrodes is 200 and the number of signal electrodes is 640. These figures for the numbers of electrodes may be changed as desired. These numbers of electrodes may be considered to be provided in the effective display region.

While only certain embodiments of the present invention have been described, it will be apparent to those skilled in the art that various changes and modifications may be made therein without departing from the spirit and scope of the present invention as claimed.

What is claimed is:

1. A liquid crystal display device containing an X-Y matrix type liquid crystal display panel having M (M>1) signal electrodes and N (N>1) scanning electrodes opposed to each other in the matrix, comprising:

polarity inverting means for inverting a polarity of a voltage waveform applied to the signal electrodes and signal electrodes of the liquid crystal display panel at intervals of n horizontal scanning periods, n being greater than 1 and less than N, and for randomly setting a timing for inverting the polarity of the voltage waveform for a predetermined number of frames.

2. The liquid crystal display device as claimed in claim 1, wherein said polarity inverting means comprises:

a random number generating circuit;

latch means, operatively connected to said random number generating circuit, for storing output from said random number generating circuit for a predetermined number of frames;

frequency counter means for counting said predetermined number of frames; and control signal output means for randomly outputting a polarity reversal control signal corresponding to an output from said frequency counter means.

3. The liquid crystal display device as claimed in claim 1, wherein said predetermined number of frames is two frames.

4. A liquid crystal display panel driving circuit for a matrix-type liquid crystal display panel having M signal electrodes and N scanning electrodes, comprising:

signal electrode driving means, operatively connected to the signal electrodes, for driving the signal electrodes with a first voltage waveform;

scanning electrode driving means, operatively connected to the scanning electrodes, for driving the scanning electrodes with a second voltage waveform;

control means, operatively connected to said signal electrode driving means and said scanning electrode driving means, for producing control signals to control the driving operation of said signal electrode driving means and said scanning electrode driving means;

said control means producing a voltage polarity reversal control signal to invert the polarity of said first and second voltage waveforms; and random inverting means, operatively connected to said control means, said signal electrode driving means, and said scanning electrode driving means, for randomly applying said voltage polarity reversal control signal to said signal electrode driving means and said scanning electrode driving means, thereby causing said first and second voltage waveforms to randomly invert voltage polarity.

5. The driving circuit as claimed in claim 4, wherein said control signals produced by said control means includes a display data signal, a dot clock pulse signal, a latch pulse signal, and a start pulse signal.

6. The driving circuit as claimed in claim 4, wherein said random inverting means comprises:

random number generating means for generating a signal having a variable frequency and having a plurality of phases, the number of phases being controlled by the frequency of said signal;

latch means, operatively connected to said random number generating means, for storing output from said random number generating means; counter means, operatively connected to said latch means and said control means, for counting a predetermined number of frames; and exclusive-OR means, operatively connected to said control means and said counter means, for exclusively-ORing an output from said counter means and said voltage polarity reversal control signal to cause said voltage polarity reversal control signal to be randomly applied to said signal electrode driving means and said scanning electrode driving means.

7. The driving circuit as claimed in claim 6, wherein said random number generating means comprises:

self-oscillating means for generating a signal being a frequency substantially equal to the horizontal scanning frequency; and dividing means, operatively connected to said self-oscillating means, for dividing said signal into a plurality of phases.

8. The driving circuit as claimed in claim 6, wherein said plurality of phases is four phases.

9. The driving circuit as claimed in claim 6, wherein said plurality of phases is ten phases.

10. A method for driving a matrix-type liquid crystal display panel comprising the steps of:

(a) driving signal electrodes with a first voltage waveform;

(b) driving scanning electrodes with a second voltage waveform;

(c) producing a voltage polarity reversal control signal to cause the first and second voltage waveforms to invert voltage polarity; and (d) randomly applying the voltage polarity reversal control signal to signal and scanning electrodes driving circuits to cause the first and second voltage waveforms to randomly invert voltage polarity.

11. The method as claimed in claim 10, wherein said step (d) comprises the steps of:

(e) generating a signal having a variable frequency and a plurality of phases; and (f) exclusively-ORing the voltage polarity reversal control signal of said step (c) with the signal of said step (e) to cause the random application of the voltage polarity reversal control signal.

* * * * *